US007398570B2

(12) United States Patent
Seago

(10) Patent No.: US 7,398,570 B2
(45) Date of Patent: Jul. 15, 2008

(54) MATTRESS COVER WITH FIT ENHANCING COMPOSITE END PANELS

(75) Inventor: Michael E. Seago, Louisville, KY (US)

(73) Assignee: Louisville Bedding Company, Louisville, KY (US)

( * ) Notice: Subject to any disclaimer, the term of this patent is extended or adjusted under 35 U.S.C. 154(b) by 66 days.

(21) Appl. No.: 11/537,843

(22) Filed: Oct. 2, 2006

(65) Prior Publication Data

US 2008/0078029 A1 Apr. 3, 2008

(51) Int. Cl.
*A47G 9/04* (2006.01)
*A47G 9/02* (2006.01)

(52) U.S. Cl. ..... 5/497; 5/502

(58) Field of Classification Search ..... 5/497, 5/495, 496, 482, 486, 498, 499, 502
See application file for complete search history.

(56) References Cited

U.S. PATENT DOCUMENTS

| | | | |
|---|---|---|---|
| 22,038 | A | 11/1858 | Solis |
| 167,732 | A | 9/1875 | Blanchard |
| 286,037 | A | 10/1883 | Mayall |
| 750,780 | A | 1/1904 | O'Brien |
| 1,462,279 | A | 7/1923 | Guinzburg |
| 1,620,162 | A | 3/1927 | Martin |
| 1,748,743 | A | 2/1930 | Wedler |
| 1,771,872 | A | 7/1930 | Brock et al. |
| 1,825,909 | A | 10/1931 | Levi |
| 1,926,429 | A | 9/1933 | Bendelari |
| 1,942,111 | A | 1/1934 | Levi |
| 2,013,347 | A | 9/1935 | Harris |
| 2,045,630 | A | 6/1936 | Bratman |

(Continued)

FOREIGN PATENT DOCUMENTS

CA 508069 * 12/1954

(Continued)

OTHER PUBLICATIONS

Perfect Fit Industries Advertisement: "Perfect Fit Leads Again", 1989.*

(Continued)

*Primary Examiner*—Alexander Grosz
(74) *Attorney, Agent, or Firm*—Banner & Witcoff, Ltd.

(57) ABSTRACT

A fitted mattress cover for enveloping the top, side and end surfaces of a mattress is constructed to accommodate a range of mattress peripheral sizes and thicknesses. The construction utilizes composite end panels which include stretch end panels covering lower partial portions of the mattress end surfaces and which impart recovery forces to effectively grip the mattress and thereby minimize the shifting of the cover relative to the mattress. At the same time, the look and feel of the mattress covering, which may be of importance especially in the case of a fitted sheet, is improved, by virtue of the fact that the side panels can be formed as uninterrupted unitary extensions of the material forming the top side panel, or other material based upon aesthetic considerations, as can upper partial portions (extension end panels) of the composite end panels. In a related aspect, stretchability of the mattress cover skirt may be imparted in a post-manufacture heat treatment finishing step, which may included a laundry wash and dry cycle.

23 Claims, 7 Drawing Sheets

U.S. PATENT DOCUMENTS

| | | | |
|---|---|---|---|
| 2,066,428 | A | 1/1937 | Straus |
| 2,112,892 | A | 4/1938 | Hardie et al. |
| 2,142,336 | A | 1/1939 | Selinger |
| 2,161,448 | A | 6/1939 | Bishop |
| 2,162,755 | A | 6/1939 | Shauer |
| 2,183,828 | A | 12/1939 | Trubitz |
| 2,191,956 | A | 2/1940 | Coldren |
| 2,191,963 | A | 2/1940 | London |
| 2,195,039 | A | 3/1940 | Shauer |
| 2,197,188 | A | 4/1940 | Lilley |
| 2,245,779 | A | 6/1941 | Heil |
| 2,302,259 | A | 11/1942 | Rothfuss |
| 2,414,927 | A | 1/1947 | Chapman |
| 2,454,463 | A | 11/1948 | Kromer |
| 2,528,313 | A | 10/1950 | Kessler |
| 2,569,627 | A | 10/1951 | Black |
| 2,571,543 | A | 10/1951 | Connor |
| 2,598,141 | A | 5/1952 | Simpson |
| 2,605,483 | A | 8/1952 | Ridenhour |
| 2,624,893 | A | 1/1953 | Harris |
| 2,637,049 | A | 5/1953 | Kromer |
| 2,639,444 | A | 5/1953 | De Monsabert |
| 2,696,872 | A | 12/1954 | Kurland et al. |
| 2,778,412 | A | 1/1957 | Trubitt |
| 2,793,683 | A | 5/1957 | Trubitt |
| 2,856,615 | A | 10/1958 | Cirocco |
| 2,942,280 | A | 6/1960 | May, Jr. |
| 2,963,715 | A | 12/1960 | Young |
| 2,994,094 | A | 8/1961 | Hester |
| 3,013,283 | A | 12/1961 | Steffinich |
| 3,020,566 | A | 2/1962 | Anderson et al. |
| 3,114,156 | A | 12/1963 | Cobb |
| 3,142,072 | A | 7/1964 | Goodson, Jr. |
| 3,144,666 | A | 8/1964 | Mazera et al. |
| 3,150,621 | A | 9/1964 | Warnock |
| 3,181,179 | A | 5/1965 | Roddey, Jr. |
| 3,238,748 | A | 3/1966 | York et al. |
| 3,258,942 | A | 7/1966 | Mednick |
| 3,273,175 | A | 9/1966 | Anderson et al. |
| 3,290,702 | A | 12/1966 | Seltzer |
| 3,336,644 | A | 8/1967 | Dusenbury et al. |
| 3,371,668 | A | 3/1968 | Johnson |
| 3,438,068 | A | 4/1969 | Anderson et al. |
| 3,468,748 | A | 9/1969 | Bassett |
| 3,552,154 | A | 1/1971 | Lesley |
| 3,575,782 | A | 4/1971 | Hansen |
| 3,670,345 | A | 6/1972 | Doll et al. |
| 3,789,441 | A | 2/1974 | Weiss |
| 3,795,019 | A | 3/1974 | Fragas |
| 3,857,124 | A | 12/1974 | Hadley |
| 3,906,559 | A | 9/1975 | Bahr |
| 3,996,633 | A | 12/1976 | Burke |
| 3,999,233 | A | 12/1976 | Morris |
| 4,009,597 | A | 3/1977 | Wall |
| 4,042,986 | A | 8/1977 | Goodman et al. |
| 4,081,301 | A | 3/1978 | Buell |
| 4,185,341 | A | 1/1980 | Scales |
| 4,338,693 | A | 7/1982 | Vitale |
| 4,370,939 | A | 2/1983 | Fontcuberta |
| 4,384,380 | A | 5/1983 | Glaha et al. |
| 4,386,439 | A | 6/1983 | Roccograndi et al. |
| 4,422,195 | A | 12/1983 | Russo et al. |
| 4,494,262 | A | 1/1985 | Robertson |
| 4,536,028 | A | 8/1985 | Jones et al. |
| 4,552,795 | A | 11/1985 | Hansen et al. |
| 4,606,964 | A | 8/1986 | Wideman |
| 4,644,598 | A | 2/1987 | McGuire et al. |
| 4,651,370 | A | 3/1987 | Vitale |
| 4,662,013 | A | 5/1987 | Harrison |
| 4,671,568 | A | 6/1987 | Greer |
| 4,672,702 | A | 6/1987 | Isham |
| 4,682,379 | A | 7/1987 | Dugan |
| 4,682,555 | A | 7/1987 | Bierbaum et al. |
| 4,703,530 | A | 11/1987 | Gusman |
| 4,704,753 | A | 11/1987 | Lunt |
| 4,707,398 | A | 11/1987 | Boggs |
| 4,720,415 | A | 1/1988 | Vander Wielen et al. |
| 4,723,330 | A | 2/1988 | Kellogg et al. |
| 4,723,331 | A | 2/1988 | Weiss |
| 4,727,608 | A | 3/1988 | Joyce |
| 4,734,947 | A | 4/1988 | Vitale |
| 4,737,394 | A | 4/1988 | Zafiroglu |
| 4,741,949 | A | 5/1988 | Morman et al. |
| 4,742,788 | A | 5/1988 | Dugan |
| 4,744,118 | A | 5/1988 | Lunt |
| 4,756,942 | A | 7/1988 | Aichele |
| 4,757,564 | A | 7/1988 | Goodale |
| 4,773,238 | A | 9/1988 | Zafiroglu |
| 4,781,966 | A | 11/1988 | Taylor |
| 4,801,482 | A | 1/1989 | Goggans et al. |
| 4,841,588 | A | 6/1989 | Harbin et al. |
| 4,876,128 | A | 10/1989 | Zafiroglu |
| 4,879,169 | A | 11/1989 | Zafiroglu |
| 4,899,408 | A | 2/1990 | Illingworth |
| 4,937,904 | A | 7/1990 | Ross |
| 4,962,546 | A | 10/1990 | Vitale |
| 4,980,941 | A | 1/1991 | Johnson, III |
| 4,985,953 | A | 1/1991 | Seago |
| 4,998,421 | A | 3/1991 | Zafiroglu |
| 5,003,655 | A | 4/1991 | Kafai |
| 5,027,460 | A | 7/1991 | Honig |
| 5,029,353 | A | 7/1991 | Kimball et al. |
| 5,041,255 | A | 8/1991 | Zafiroglu |
| 5,042,098 | A | 8/1991 | Stultz |
| 5,046,207 | A | 9/1991 | Chamberlain |
| 5,056,441 | A | 10/1991 | Seago |
| 5,075,142 | A | 12/1991 | Zafiroglu |
| 5,127,115 | A | 7/1992 | Williams et al. |
| 5,131,104 | A | 7/1992 | Larson |
| 5,133,097 | A | 7/1992 | Pyles |
| 5,165,128 | A | 11/1992 | Honig |
| 5,177,821 | A | 1/1993 | Kawtoski |
| 5,249,322 | A | 10/1993 | Seago |
| 5,271,112 | A | 12/1993 | Bible et al. |
| 5,287,574 | A | 2/1994 | Kardell et al. |
| 5,325,555 | A | 7/1994 | Whitley |
| 5,513,403 | A | 5/1996 | Wooten, Jr. |
| 5,530,979 | A | 7/1996 | Whitley |
| 5,542,137 | A | 8/1996 | Byfield |
| 5,603,132 | A | 2/1997 | Zafiroglu et al. |
| 5,625,912 | A | 5/1997 | McCain et al. |
| 5,636,393 | A | 6/1997 | Zafiroglu et al. |
| 5,809,593 | A | 9/1998 | Edwards |
| 5,996,148 | A | 12/1999 | McCain et al. |
| 6,164,092 | A | 12/2000 | Menaker |
| 6,272,701 | B1 | 8/2001 | Zafiroglu |
| 6,353,947 | B1 | 3/2002 | McCain et al. |
| 6,381,778 | B1 | 5/2002 | Peterson |
| 6,393,640 | B1 | 5/2002 | Dalis |
| 6,463,606 | B2 | 10/2002 | Barker et al. |
| 6,499,157 | B1 | 12/2002 | McCain et al. |
| 6,532,608 | B2 | 3/2003 | Schreiner |
| 6,704,955 | B1 | 3/2004 | Jeffries et al. |
| 6,725,477 | B2 | 4/2004 | Ciaglia et al. |
| 6,799,341 | B2 | 10/2004 | Wootten, Jr. |
| 6,823,544 | B2 | 11/2004 | Treece |
| 6,842,921 | B1 | 1/2005 | Tsiarkezos et al. |
| 6,883,193 | B2 | 4/2005 | Brooks et al. |
| D512,869 | S | 12/2005 | Green-Law |
| 6,983,500 | B2 | 1/2006 | Wootten |
| 6,988,283 | B2 | 1/2006 | Griffin |
| 7,003,832 | B2 | 2/2006 | Wilson |
| 7,007,325 | B1 | 3/2006 | Gomeh |
| 2002/0088054 | A1 | 7/2002 | McCain et al. |

| | | | |
|---|---|---|---|
| 2003/0056290 | A1 | 3/2003 | Macdonald |
| 2004/0031100 | A1 | 2/2004 | Creech |
| 2004/0040090 | A1 | 3/2004 | Wootten |
| 2004/0163174 | A1 | 8/2004 | Treece |
| 2005/0011007 | A1* | 1/2005 | Lintner |
| 2005/0034236 | A1* | 2/2005 | Te Selle |
| 2005/0193490 | A1* | 9/2005 | Macdonald |
| 2005/0284189 | A1* | 12/2005 | Stewart |
| 2006/0046591 | A1* | 3/2006 | Hairston et al. |

FOREIGN PATENT DOCUMENTS

| | | | |
|---|---|---|---|
| DE | 2800586 | * | 12/1979 |
| DE | 3635417 | * | 4/1988 |
| EP | 425466 | * | 2/1991 |
| FR | 2694177 | * | 2/1994 |
| GB | 701899 | * | 1/1954 |
| GB | 891355 | * | 3/1962 |

OTHER PUBLICATIONS

Affidavit of Charles Lohman executed Feb. 27, 2007, including Exhibit 1 thereto (comprising a Jacobson's Home Furnishing Sales Catalog Page, a letter dated Jul. 19, 1966 attaching the same, and an ad insert entitled "Olde Kentucky Brand Quilted Sidewall Box Spring Cover").*

Documents submitted in Perfect Fit U.S. Appl. No. 08/976,718 (now USP 5,996,148): "Sack-ette" box spring cover, Perfect Fit Industries, Inc. Monroe, NC, 1980, four photocopy sheets.*

* cited by examiner

MATTRESS COVER WITH FIT ENHANCING COMPOSITE END PANELS

FIELD OF THE INVENTION

The present invention relates to mattress covers, and more particularly to fitted mattress covers having a fabric material top panel to overlay the top surface of a mattress, and side and end panels depending from the top panel for fitting around the sides and ends of the mattress. As used herein, the term mattress cover is used in its generic sense to mean sheets, and covers, e.g., mattress pads used underneath sheets to protect the mattress and/or provide a softer surface, and bed spreads used over sheets to provide a neat or decorative appearance to a bed. The present invention has particularly advantageous application to fitted bed sheets.

BACKGROUND OF THE INVENTION

The present inventor has described, in his U.S. Pat. Nos. 5,249,322; 5,056,441; and 4,985,953, assigned to Louisville Bedding Co., fitted mattress coverings which make highly advantageous use of a skirt constructed of material which is stretchable in its longitudinal dimension, i.e., horizontally about the periphery of a mattress upon which it is installed. Such a construction provides a firm grip on the mattress to thereby prevent shifting of the cover on the mattress during use, and to accommodate mattresses of differing thicknesses and peripheral dimensions (length and width), while pulling the skirt in tightly against and underneath the mattress so as to avoid sag or loose fabric otherwise creating a sloppy appearance.

In one embodiment of the aforementioned Seago patents, the depending skirt is formed from a separate strip of material which is attached about the periphery of an inelastic top panel of the mattress covering, e.g., mattress pad. The separate strip comprises a gathered single layer of substantially inelastic fabric material with a plurality of spaced-apart parallel, elongated cords, such as elastic strips or yarn, stitched into the inelastic skirt material so as to extend generally perpendicularly to the longitudinal axes of folds of gathers which form with the elastic cords being in a relaxed condition prior to the installation of the cover on the mattress.

In another embodiment of the above-mentioned Seago patents, the skirt comprises side and end panels formed as unitary extensions of the top panel. These panels are stitched together at their ends to form closed corners of the mattress cover, and the skirt thus formed is made stretchable by stitching into the panels elastic cords under tension, which, when permitted to relax, form gathers similar to the first embodiment.

Mattress pads constructed in accordance with the teachings of the above-mentioned Seago patents have met with substantial commercial success. The present assignee's Expand-A-Grip® mattress pads, which are covered by the patents, are industry leaders. The principles described in the Seago patents are fully applicable to fitted sheets as well. However, the marketplace adoption of the constructions in sheets has been significantly lower.

This is believed to be due, at least in part, to the sensitivity of users and purchasers of bedding products with respect to the appearance and feel of a fitted sheet when it is installed and used on a mattress. The sides of a fitted sheet installed on a mattress receive much more exposure, both visually and to touch, than do the sides of a fitted mattress pad. Whereas the sidewall of a mattress pad generally remains covered by an overlying fitted sheet during use, a fitted sheet is revealed upon the drawing back of a top sheet and blankets or other bed coverings. As a result, consumers of bedding products may favor a sheet that provides an uninterrupted continuation of the sheet material (e.g., a high thread count woven cotton fabric) from the main (top) panel to the sidewalls. A fitted sheet having its skirt constructed of a separate elasticized strip of material attached to and extending about the entire periphery of a separate top panel would, of course, not provide such an uninterrupted continuation of the sheet material.

The look/feel issue mentioned above may be alleviated somewhat with the second one of the above-mentioned embodiments of the Seago patents, since in that embodiment, the side panels are provided as integral extensions of the top panel. Thus, the construction provides a continuous wrap-around of the upper edge of the mattress, which extends down to the first line of stitched-in elastic cord. As illustrated in the Seago patents, typically this first line of cord would be spaced downwardly from the top surface of the mattress. This construction also has the advantage of forming well defined closed corners for neatly fitting the corners of the mattress. Nonetheless, the appearance of the lines of stitched-in elastic cord may be viewed as an undesirable deviation from the conventional uninterrupted extension of the main panel material over the full depth of the mattress.

As a variation on the above-described mattress cover constructions of the Seago patents, Whitely U.S. Pat. No. 5,530,979, assigned to Perfect Fit Industries, proposes to provide a two-part skirt construction. A first upper part of the skirt (an inelastic side skirt) is provided as an integral extension of the inelastic material used to form the main panel serving to cover the mattress top side. A second (lower) part of the skirt (elastic underskirt) is formed by a strip of material attached to the bottom edge of the side skirt about its entire periphery, and is made elastically stretchable in its longitudinal dimension, i.e., peripherally about a mattress on which it is installed, for contraction under a mattress. A variety of known elastically stretchable fabric constructions are used to form the second elastic part.

In a manner similar to the above-mentioned second embodiment of the Seago patents, such a construction reduces the coverage area of the elastic material, and also permits the formation of well-defined closed corners. Nonetheless, a seam attaching the strip of elastic material to the inelastic side skirt, as well as the differentiated elastic material itself, will be present and visible along the mattress sidewalls when the construction is used in a fitted sheet. Thus, the aesthetics and touch/feel related drawbacks mentioned above persist.

Isham U.S. Pat. No. 4,672,702 discloses a mattress covering comprising a main panel provided with mattress sidewall covering extensions. These extensions are provided with rectangular cut-outs at their corners. The cut-outs accommodate the ends of stretch fit end panels having a length exceeding the width of the mattress upon which the cover is to be installed, such that when the cover is installed the stretch fit panels wrap around the corners of the mattress. Each stretch panel is sewn along its upper edge to a corresponding end edge of the main panel, which in turn lies in registry with an end edge of the mattress top surface periphery. The ends of the stretch end panels are sewn to corresponding edges of the cut-outs provided in the mattress sidewall covering extensions. Isham discloses that stretch fabrics suitable for use in forming the stretch panels are typically elastic in only one direction, and that when such materials are used the rectangular stretch panel should be cut such that the stretch takes place along a line perpendicular to the panel's long edge, i.e., to provide stretchability in the up and down direction.

The Isham configuration has the drawback of not providing significant stretchability in the peripheral direction of the skirt. Such peripheral stretchability in a skirt has proven to be much more effective than up-down stretch in providing a secure grip on a range of mattress sizes and thicknesses. Moreover, in the case of a fitted sheet construction, the extension of the stretch end panels about the four corners of the mattress, into sidewall regions at the head and foot ends of the bed, detrimentally places differentiated elastic material along sidewall areas which are exposed upon the drawing back of a top sheet, blanket and/or other bed covering.

Johnson, III U.S. Pat. No. 4,980,941 discloses a fitted bedding product wherein portions of side panels thereof are formed of elastic material. In particular, Johnson, III teaches use of stretch panels formed from a three layer laminate construction (with seams extending vertically). One disclosed embodiment includes a configuration of corner encompassing stretch end panels which appears to be generally similar to that disclosed by the Isham patent, including the attendant shortcomings.

Kardell et al. U.S. Pat. No. 5,287,574, shown on its face to be assigned to Restful Knights, proposes a fitted mattress covering which employs elasticized head and foot panels. An upper edge of each panel is secured, by conventional sewing methods, to a top portion of a unitary main panel of the mattress cover. The ends of the head and foot panels are sewn to corresponding ends of overhanging first and second side portions of the unitary main panel. The elasticized head and foot panels are provided in a trapezoidal shape, such that the bottom edges of the head and foot panels have a shorter length than those panels' top edges. According to the patent, this will cause the head and foot panels to exert greater tension on the side portions of the main panel near the lower edges thereof, to assure a secure fit for a range of mattress thicknesses.

The Kardell et al. trapezoidal panel configuration, and the manner of its attachment to the main panel, are such as to induce an elastic recovery force that increases linearly from essentially zero at the point of attachment of the top edge (where the elastic material is unstretched at the time of being bound to the main panel material) to a maximum along the bottom edge (where the greatest amount of stretch is required to attach the end panels to the ends of the overhanging side portions of the main panel). As a result, the ability of the mattress covering to grip tightly to the mattress and avoid shifting may be compromised, especially at an upper portion of the corners of the mattress sidewalls and end walls, where loose material may also create a sloppy appearance. Additionally, the corner seams may become distorted as a result of the non-uniform tension forces, leading to a degraded fit and appearance at the corners.

SUMMARY OF THE INVENTION

In a first aspect, the invention is embodied in a fitted mattress cover including a top panel of material for fitting in overlaying relationship to the top surface of a mattress and a peripheral skirt depending from the periphery of the top panel for fitting in overlaying relationship to the sides and ends of the mattress. The peripheral skirt includes a pair of extension sidewall panels attached to the top panel. The sidewall panels are sized and configured to overlie substantially the entire sides of the mattress. A pair of extension end panels are attached to the top panel. At least one of the extension end panels is sized and configured to overlie substantially only an upper partial portion of the end walls of the mattress. At least one stretch end panel is provided, which is sized and configured to overlie substantially only a lower partial portion of a corresponding end wall below the upper partial portion. The stretch end panel is formed of a stretchable material stretchable in at least a longitudinal direction thereof so as to generate an at least partial recovery force. The stretch end panel is attached along its upper edge thereof to a corresponding peripheral edge of a corresponding one of the extension end panels, and is attached at its ends, either directly or indirectly, to corresponding end edges of the sidewall panels. As a result, upon installation of the mattress covering on a mattress, the at least partial recovery force pulls on the end edges of the sidewall panels.

Such a construction has particularly advantageous application to a fitted sheet, wherein the recovery forces of the stretch end panels can be used to effectively grip the mattress and thereby minimize shifting of the sheet. At the same time, the look and feel of the mattress covering, which may be of importance especially in the case of a fitted sheet, is improved, by virtue of the fact that the side panels can be formed as uninterrupted unitary extensions of the material forming the top side panel, or other aesthetically dictated material, as can upper partial portions (extension end panels) of the composite end panels.

In a second aspect, the invention is embodied in a method of making a fitted mattress cover having a top panel for fitting in overlaying relationship to a top surface of a mattress and a peripheral skirt for overlaying the sides and ends of the mattress. In the method, a main fabric piece is formed having a top panel sized and configured for fitting in overlaying relationship to the top surface of a mattress, two opposite extension side panels coextensive in length with the top panel so as to overlie substantially the entire sides of the mattress, and two opposite extension end panels coextensive in length with the width of the top panel. At least one of the opposite extension end panels is given a depth which is less than a depth of the two opposite side panels, so as to overlie substantially only an upper partial portion of the endwalls of the mattress. At least one stretch end panel is attached along a longitudinal edge thereof to a corresponding peripheral edge of a corresponding one of the extension end panels to form a composite end panel. The stretch end panel is sized and configured to overlie substantially only a lower partial portion of the end walls below the upper partial portion. The stretch end panel is formed of a stretchable material stretchable in at least a longitudinal direction thereof so as to generate an at least partial recovery force when placed in a stretched condition. Adjacent end edges of the composite end panels and side panels are attached together to form the peripheral skirt.

In a third aspect, the invention is embodied in a method of imparting mattress gripping stretchability to a mattress cover including a top panel of material for fitting in overlaying relationship to the top surface of a mattress, and a peripheral skirt depending from the periphery of the top panel for fitting in overlaying relationship to the sides and ends of the mattress. The method comprises heat treating at least a portion of the peripheral skirt after it has been attached to the top panel, to thereby cause the portion of the peripheral skirt to contract in a longitudinal direction thereof. This forms a stretchable material stretchable in at least a longitudinal direction of the skirt. Stretching of the stretchable material generates an at least partial recovery force, whereby upon installation of the mattress covering the at least partial recovery force causes the skirt to grip the mattress.

The above and other objects, features, aspects and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
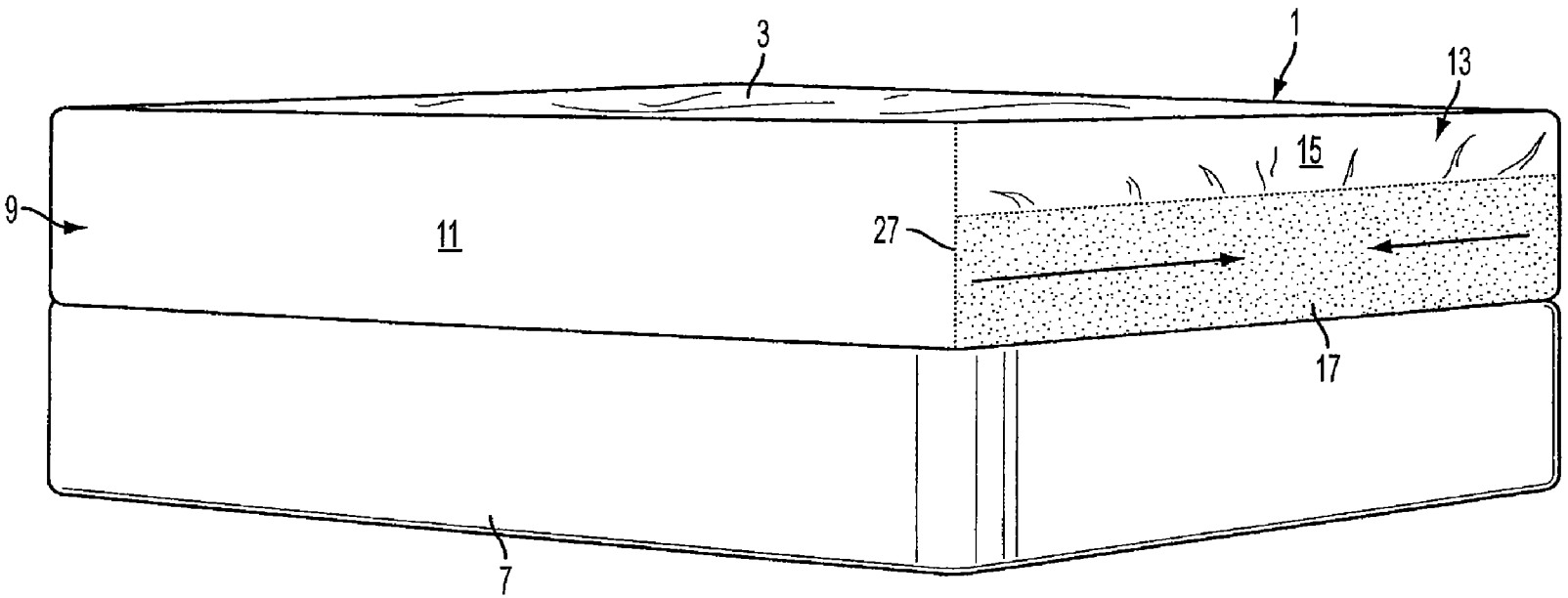
FIG. 1 is a corner perspective view of an exemplary mattress covering (specifically a fitted sheet) in accordance with the present invention, installed upon a mattress which is situated on top of a box spring or foundation.
Figure 2:
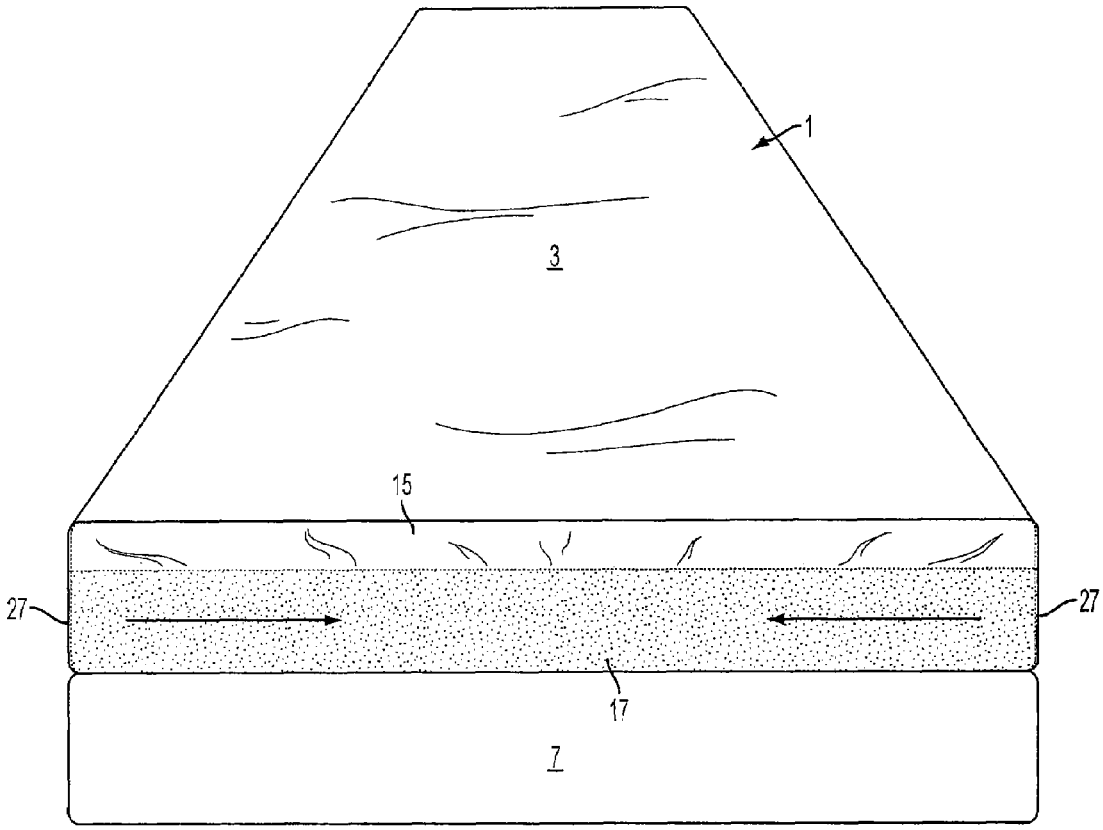
FIG. 2 is an end perspective view of the mattress covering/mattress/box spring combination illustrated in FIG. 1.
Figure 3:
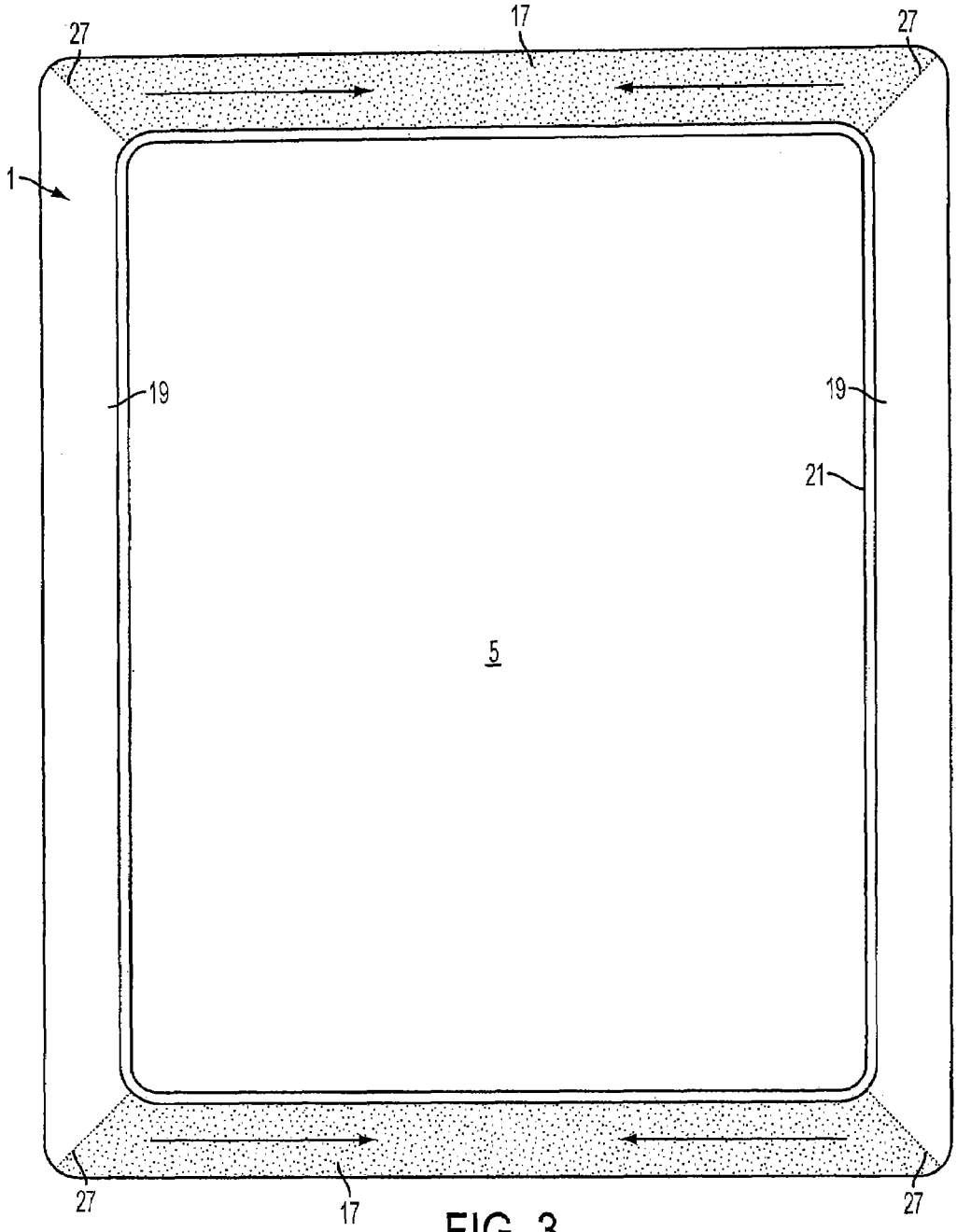
FIG. 3 is a bottom plan view of the mattress covering illustrated in FIG. 1, and the mattress upon which it is installed.

With reference to FIGS. 1, 2 and 3, there is shown an example of a fitted mattress cover, and specifically a fitted bed sheet 1, in accordance with the present invention. Fitted bed sheet 1, which is shown installed on a conventional mattress 5 (visible in FIG. 3), includes a top panel 3 of generally rectangular peripheral shape for fitting in overlaying relationship to the top surface of the mattress. Mattress 5 may sit upon a conventional box spring or other mattress foundation 7. A peripheral skirt 9 is attached at the peripheral edge of top panel 3 and depends therefrom for fitting in overlaying relationship to the sides and ends of the mattress. In accordance with an aspect of the present invention, peripheral skirt 9 is a composite skirt comprising (1) panels formed as unitary extensions of top panel 3; and (2) separate stretchable end panels.

In particular, peripheral skirt 9 comprises extension side panels 11 that may be integrally formed as unitary parts of the main piece of material forming top panel 3, and composite end panels 13. Composite end panels 13 comprise extension end panels 15, that may be formed as integral unitary parts of the main piece of material forming top panel 3, and separately formed, attached stretch end panels 17. Stretch end panels 17 are attached along their respective upper edges to the corresponding peripheral edges of the extension end panels 15. As will be described in further detail, this attachment is effected while maintaining the attachment edge of the partial end panels under tension in a longitudinally stretched condition. As such, upon being permitted to relax, the recovery of the stretch material to its relaxed state draws the material inwardly upon itself and carries with it the peripheral edges of extension end panels 15.

Various relative sizes of the extension end panels 15 and stretch end panels 17 may be employed, depending, e.g., on the overall desired skirt depth and the materials used. In one example, where a total skirt depth of approximately 15" is provided, approximately 10" may be allocated to the stretch end panels and approximately 5" may be allocated to the extension end panels (2:1 ratio).

Figure 6:
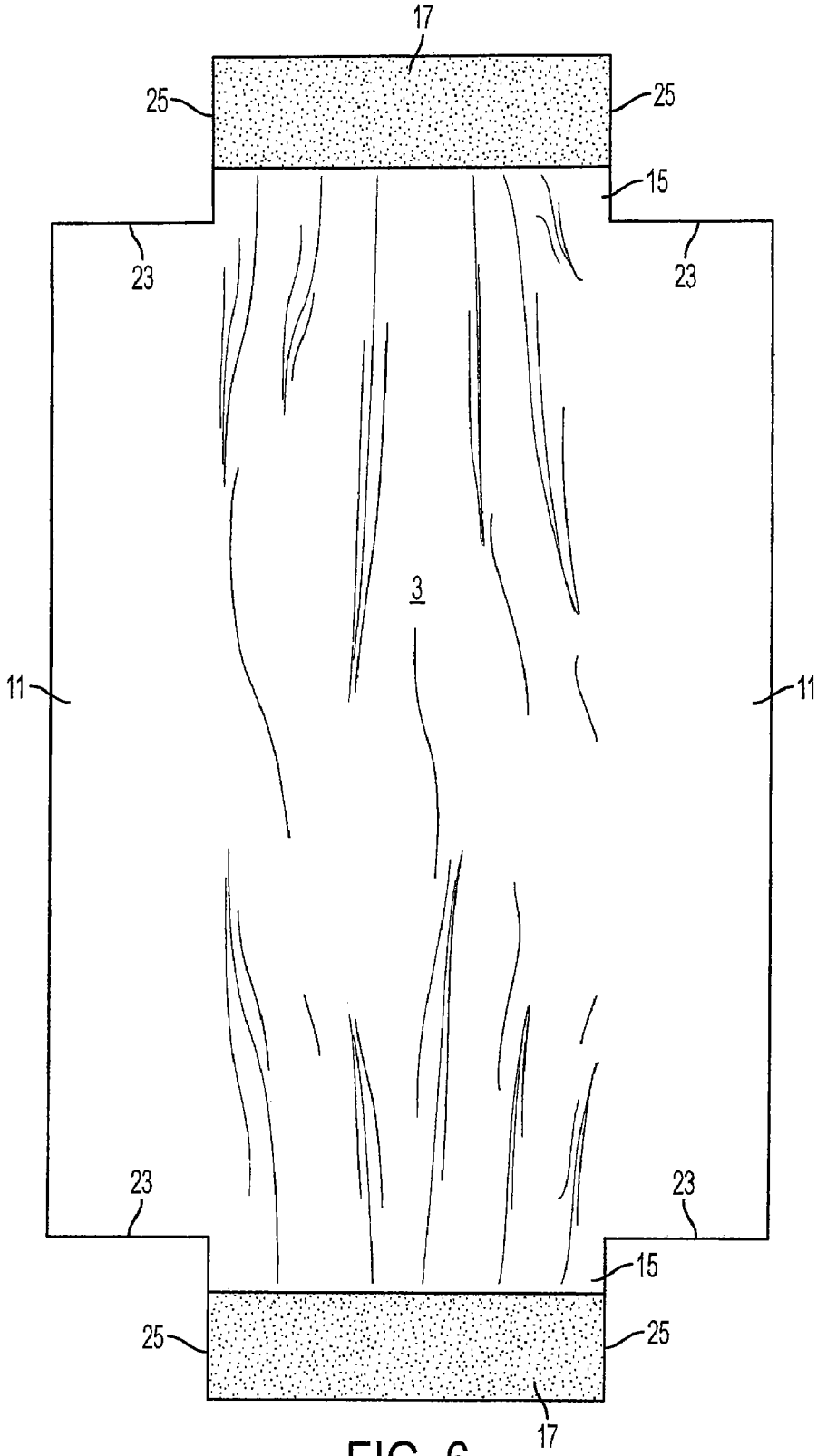
FIG. 6 is a plan view depicting a composite blank of fabric material formed by the attachment of the stretch end panels to the main piece of material as illustrated in FIGS. 4 and 5.

In an exemplary embodiment, a single piece of material forms top panel 3, extension side panels 11, and extension end panels 15. That material may be a substantially inelastic and substantially non-stretchable material, e.g., of woven cotton (traditional muslin). Alternatively, this main piece of material may comprise a stretchable fabric; that fabric may or may not comprise elastic threads or cords. For example, the material may be of stretchable knitted cotton, of the type commonly used for T-shirts. As another possibility, the material could be a stretchable knit of wicking polyester. Regardless of the type of fabric used for the main piece of material, so long as the edges of the stretch end panels 17 are longitudinally stretched at the time of attachment to the main piece of material, the recovery of the stretch panel material following the attachment will cause the formation of gathers in the extension end panels 15 and a contraction of a central portion of top panel 3 (as generally illustrated in FIG. 6). This permits, at the time of installing sheet 1 on a mattress, stretch end panels 17 to stretch across their full width and length, without such stretch being impeded by the panels' attachment to the main piece of material (particularly extension end panels 15 thereof).

The stretch of the stretch end panels 17, upon installation of sheet 1 on mattress 5, sets up recovery forces acting inwardly toward the center of the composite end panels 13. At its opposite ends, each of composite end panels 13 is attached to corresponding end edges of side extension panels 11. Hence, the recovery forces (which may be partial recovery forces) pull peripherally on side extension panels 11, thereby tending to remove any looseness or slack in the side extension panels that might otherwise exist by virtue of the mattress covering being sized to accommodate mattresses at the upper (as well as lower) end of a range of mattress peripheral dimensions and thicknesses. The stretch recovery forces transmitted to extension side panels 11 also tend to draw in bottom peripheral edge portions 19 of extension side panels 11 underneath mattress 5, as well as the bottom peripheral edges of stretch end panels 17, as illustrated in FIG. 3, to further improve the grip and appearance of the mattress covering.

In addition, the cap structure formed by extension end panels 13, and their corner attachment to extension side panels 11, further contributes to preventing undesirable shifting of the mattress covering on the mattress, by providing well defined corners for receiving the corners of the mattress.

While a similar effective gripping action is achieved with mattress covering configurations as described in the aforementioned Seago patents, this is at some expense with respect to the look and feel of the sidewalls and end walls. This is generally of no consequence for a mattress pad, which will typically be covered by a fitted sheet. However, as previously mentioned in the Background section, the sidewalls of a fitted sheet will typically be exposed to the user(s) of a bed upon the drawing back of blanket(s), bed spread(s) and the like. Thus, the look and feel of the sidewalls is generally more important in this application.

Advantageously, sheets constructed in accordance with the present invention afford the opportunity to maintain, on the mattress sidewalls, the same uninterrupted look and feel of the top panel of material, since the sidewall covering skirt portions can be constructed as uninterrupted continuations of the top panels. Moreover, even the end panels (which are typically much less likely to be exposed to the user than the side panels) can retain in substantial part the same look and feel as the top panel by virtue of the fact that the stretch end panels may be confined to a lower partial portion of the end(s) to which they are applied.

While in the illustrated arrangement the extension side panels and extension end panels are formed as unitary extensions of top panel 3, the extension side panels and extension end panels could instead be pieces of material formed separate from the material of top panel 3, and then attached thereto. Even in this case, the present inventive approach affords the advantage that aesthetics may dictate what those materials may be, since the gripping functionality will be achieved with the stretch end panel provided at partial lower portions of at least one, and preferably both, ends of the mattress. By confining the stretch panel to a smaller area of the skirt, it is also possible to realize cost savings, due to the potentially higher cost of the stretch material in comparison to the material(s) of the remainder of the sheet or other mattress covering.

At the same time, sheets and other mattress coverings in accordance with the invention can be constructed so as to exhibit advantageous grip and fit characteristics that rival those achieved with the mattress coverings of the aforementioned Seago patents. This is due, at least in part, to a method of manufacturing a mattress covering in accordance with an aspect of the invention, which permits stretch fabrics providing a significantly stronger longitudinal pull (recovery) force to be employed for the stretch panels, as will be explained.

As can be seen in FIG. 3, an elastic strip 21 may be attached under tension to the distal or bottom peripheral edge of skirt 9. As such, when fitted sheet 1 is installed on mattress 5, elastic strip 21 contributes to the pulling of the bottom peripheral skirt edge portion 19 underneath the mattress, as seen in FIG. 3.

Figure 4:
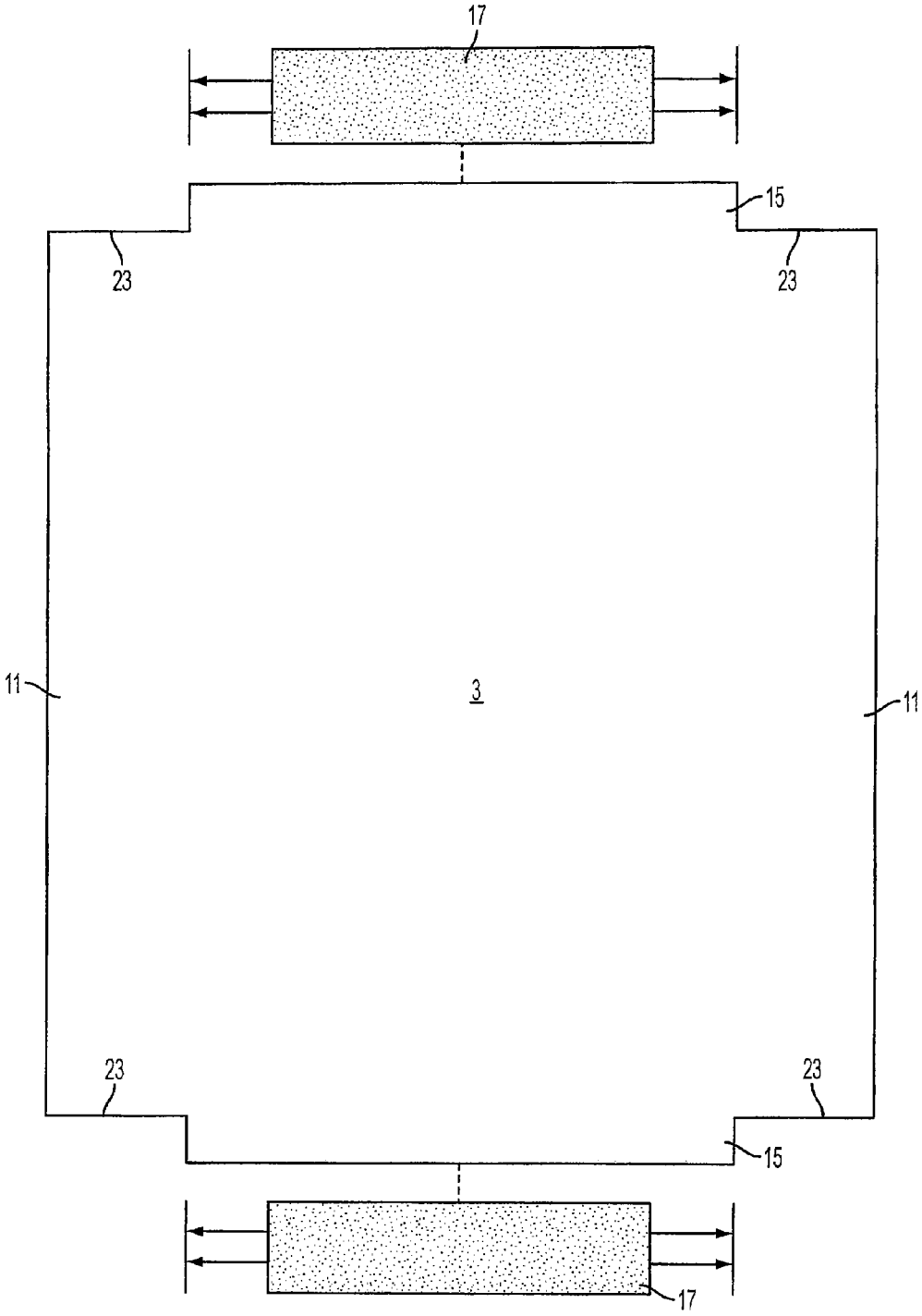
FIG. 4 is a plan view depicting the general manner of assembly of a main piece of material and two panels of stretchable material, to form the exemplary inventive mattress covering shown in FIG. 1.

Various methods may be used to construct a mattress covering (sheet, mattress pad, etc.) in accordance with the invention. In order to make a mattress cover as illustrated, a substantially inelastic non-stretchable fabric material may be cut or otherwise formed into a main piece of material providing, as illustrated in FIG. 4: top panel 3, sized and configured to overlay the top side of a mattress; two opposite extension side panels 11, unitary with top panel 3 and coextensive with the length of top panel 3 for overlaying the two opposite sides of the mattress; and two opposite extension end panels 15 unitary with the top panel 3 and coextensive with the width of the top panel 3, for partially overlaying the two opposite ends of the mattress. It will be understood, however, that the invention is not limited to a unitary main piece of material as described, but rather a main piece of material comprising extension side panels and extension end panels may be formed by respective panels of material which are separately formed and then attached together to form a composite panel structure to which the stretch end panels may be attached.

Figure 5:
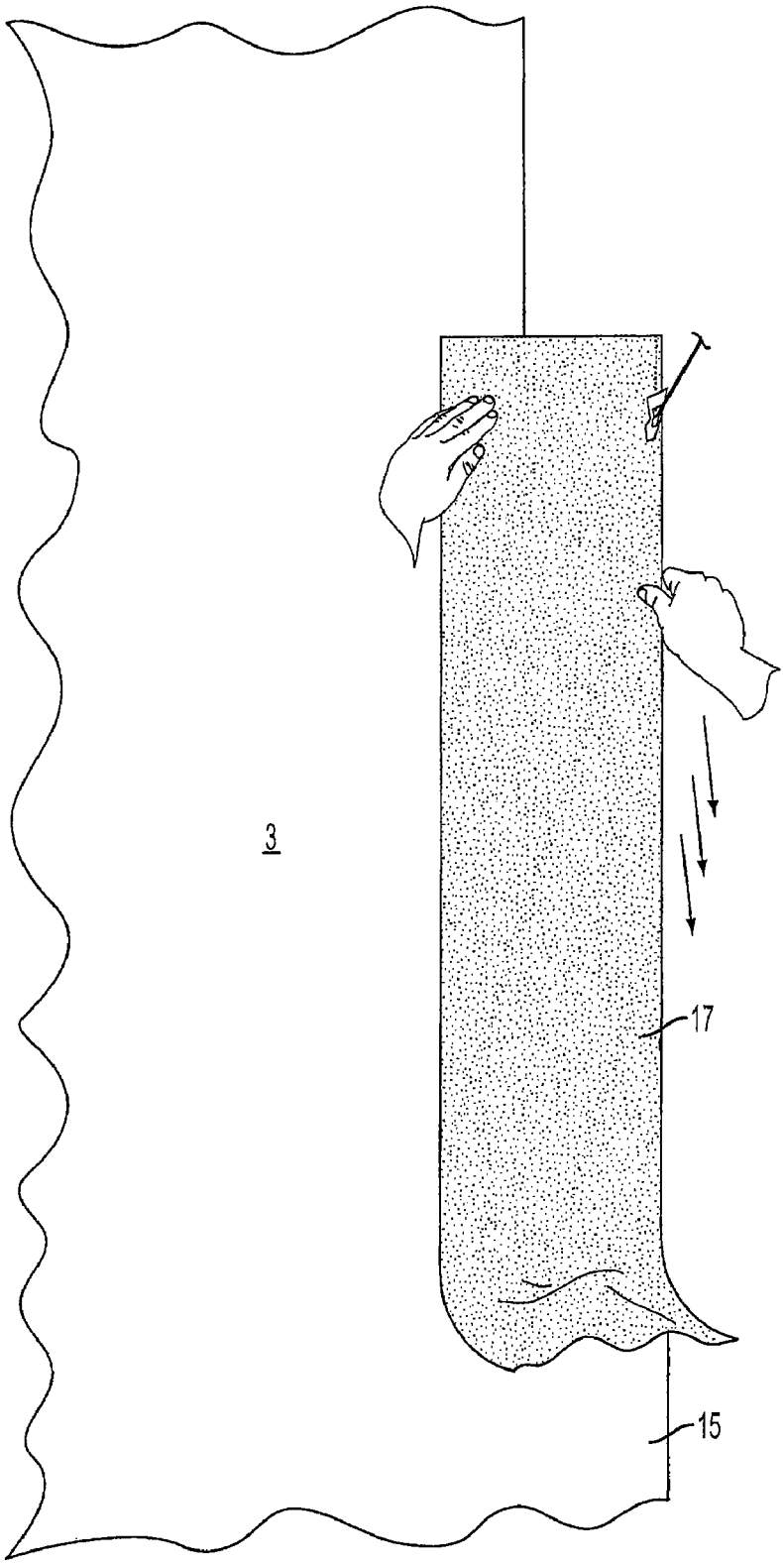
FIG. 5 is a diagrammatic partial plan view illustrating an exemplary method for sewing a stretch end panel to a respective extension end panel of the main piece of material, in accordance with an aspect of the invention.

Now, with reference to FIGS. 4 and 5, a process for attaching the stretch end panels 17 to corresponding extension end panels 15 is described. As diagrammatically depicted in FIG. 4, the stretch end panels 17 are attached to the corresponding extension end panels 15 in a tensioned, stretched state. In particular, at least the attachment edge of the elongated panel of stretch material forming stretch end panels 17 is maintained under stress or tension in the longitudinal direction as the edge of the panel is attached to the edge of panel 15. Significantly, it is not necessary to stretch the whole width of the stretch panel (top to bottom) during attachment, just the edge portion that will comprise the attachment seam.

The attachment may be effected by sewing, and the sewing may be performed by an operator using a conventional serging sewing machine. In this case, the tensioning and stretching is preferably carried out in an incremental, edgewise fashion. Since it is only necessary to stretch an edge portion along the attachment seam, it is much easier for an operator to stretch a particular stretchable material during the sewing process, as compared to the case if the entire width of the stretch panel was being stretched.

In this regard, it is relevant to note that in existing methods of attaching a strip of elasticized material about the entire periphery of a mattress cover top panel, to form a longitudinally stretchable elastic skirt, such as in the case of the mattress covers of the aforementioned Seago patents, the skirt material is stored on rolls in an elastically stretched condition. The stretched state of the material is maintained (across its width) as it is fed into the sewing machine, and up to the point that it is stitched, with release occurring progressively thereafter. Under these circumstances, due to the fact that the tension forces generated by the entire width of the skirt material are transmitted to the presser foot and needle of the sewing machine, significant limits are placed on the stretch materials that could be used and/or the degree of stretch that could be imparted to the material, so as to avoid damage to the equipment. In accordance with an aspect of the present invention, this constraint is greatly reduced by stretching the material only along the edge portion that will form the attachment seam.

An example implementation of this technique is illustrated in FIG. 5. Therein a stretch end panel 17 has been laid over a corresponding extension end panel 15, and a sewing machine operator has initially tacked the left end of the edge of the stretch material to the corresponding edge portion of extension end panel 15. This initial tack may comprise a small initial stitched segment of 1"-2" formed without tensioning the material. In the state depicted, the operator is using her left hand to guide the material as it is sewn, and the operator's right hand is pulling toward her a relatively small (e.g., 5"-15") edge segment of the stretch material, to stretch the edge segment. Preferably, the edge segment of material is stretched substantially to the limit of its recoverable elongation. The edge segment of stretch material is held in the illustrated stretched condition as the seam is sewn. This edge-focused stretch and sew process is then repeated for an adjacent (next) segment, and succeeding segments, until substantially the entire seam is completed. In a preferred embodiment, a small final segment (e.g., 1"-2") of the seam is stitched without stretching the stretch panel material. This has been found to facilitate the provision of a cleaner seam at the corners, by avoiding gathering or bunching of the extension end panels at their longitudinal ends.

Due to its elongation during the process of attachment, the stretch panel, which preferably starts out significantly (e.g., 10-40%) shorter than the width of the extension end panel 15, becomes at least coextensive with the length of panel 15. As the stretch material of stretch end panels 17 is progressively attached to the peripheral edge of extension end panel 15, the stress or tension imparted to the attachment edge may be relieved, allowing the stretch material to longitudinally contract to a relaxed condition. If, when the seam reaches the end of the extension end panel, there is some excess length of the stretch material remaining, that may be trimmed off as the corners are formed (as described below), or thereafter.

Figure 7:
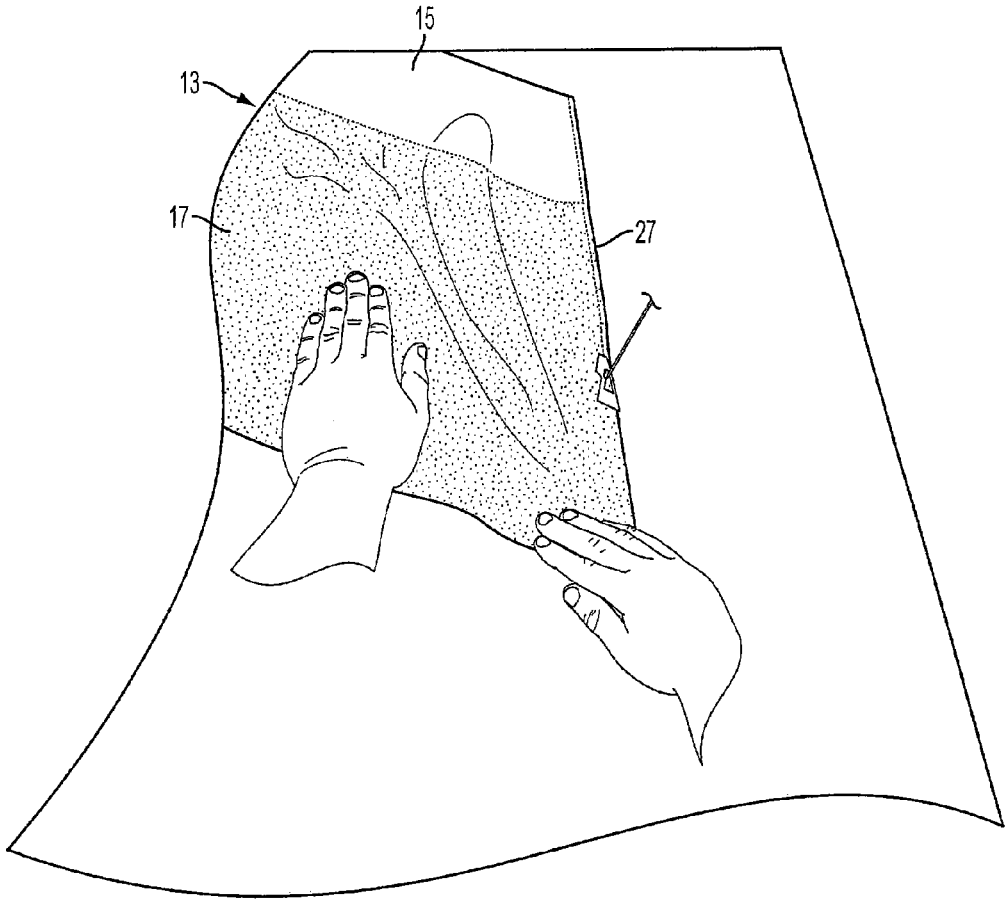
FIG. 7 is a diagrammatic partial perspective view illustrating an exemplary method for closing the corners of a mattress covering in accordance with an aspect of the invention.

Once stretch panels 17 have been attached to extension end panels 15 in the overlaid position shown in FIG. 5, the panels are unfolded to form composite end panels 13, and it is time to close the open corners. In order to do this, the extension side panels 11 may be folded downwardly about an imaginary line at the juncture of the extension side panels 11 and top panel 3, and the composite end panels 13 may be folded downwardly about an imaginary line at the juncture of the extension end panels 15 and top panel 3. As illustrated in FIGS. 6 and 7, the end edges 23 of the extension side panels 11 are then attached to the adjacent end edges 25 of the composite end panels 13, such as by sewing a seam with a conventional serging sewing machine. By serging the seam, any excess length of the stretch end panel will be trimmed off as the seam is sewn. This forms the peripheral depending skirt 9 with four corners 27, each corner 27 for receiving a respective one of the four corners of mattress 5.

Finally, the elastic strip 21 (see FIG. 3) can be attached to the formed skirt 9 in virtually any conventional or otherwise convenient means, in order to complete fitted sheet 1. For example, the bottom edge of the skirt can be folded over itself, to form a peripherally extending hem, and the elastic strip 21 can be inserted inside the hem and sewn in place. Alternatively, elastic strip 21 can be attached with a conventional serging sewing machine directly to the bottom edge of the skirt, thereby eliminating the need to form a folded-over hem.

A wide variety of stretchable materials may be used to form stretch end panels 17 of the inventive mattress covering. This includes, in addition to elastic materials having close to 100% recovery, stretch knit and like materials that have a limited but sufficient amount of recovery to impart a longitudinally directed pull-force on the ends of the side panels upon being stretched in order to fit the mattress covering on a mattress. Such materials may derive their stretchability from their integral inclusion of elastic threads, cords or fibers, or from a particular knit formula employed without components which are, per se, elastic. Additionally, the desired stretchability may be imparted to a substantially inelastic base fabric, e.g., using the techniques for stitching lines of elastic cord into a substantially inelastic base fabric disclosed in the aforementioned Seago patents. As another example, the stretch material could be a known-type elastically stretchable material formed as a laminate of non-woven elastic material sandwiched between a pair of substantially inelastic layers of material, such as described in the aforementioned Perfect Fit patent.

The stretchability of primary concern is stretchability in the longitudinal direction of the stretch end panel, so as to provide a circumferentially directed pull (recovery) force upon being installed on a mattress. In one embodiment, the material of the stretch end panels provides significant stretchability in this direction alone, being substantially non-stretchable in a transverse direction of the stretch end panels. Bi-directionally and even omni-directionally elastic/stretchable materials could also be used, however.

In one embodiment, the stretch panels are formed of a stretch woven material incorporating elastic yarns, e.g., spandex (such as Lycra), rubber or Dow XLA, extending in the longitudinal direction of the panels. The elastic yarns may comprise an elastic core covered with cotton, polyester or other fibers. One particular blend comprises 95% cotton and 5% spandex by weight. In another embodiment, the fibers are blended at a ratio of 80% cotton to 20% spandex by weight. Various fiber blends can be used with elastic or stretch yarns.

In a further embodiment of the invention, the stretch panels may be formed of a stretch knit or other elastic material that has yet to undergo a finishing process to impart stretchability to the fabric. Such a panel could be attached to the extension end panels in the manner previously described, except that the attachment, e.g., by stitching, would be without incrementally stretching the attachment edge of the material in the process. In this case, the stretchability of the stretch panels would not be imparted until a post-attachment finishing phase. Such a phase could, e.g., be a wash and dry cycle of a conventional laundry washing machine, or other heat treatment carried out by the manufacturer before packaging and sale, or by the consumer after purchase and prior to use. Since most consumers will wash new bed clothes prior to use in any event, the extra step of washing and drying fitted sheets to activate the stretch panels should not present a significant inconvenience. Such a finishing phase would serve to contract the stretch material, gathering with it the material of the extension end panels, to thereby render the material stretchable with longitudinal recovery forces capable of providing a tight fit and effectively gripping mattresses of a range of sizes upon installation, in the manner previously described. This process for imparting stretchability to a skirt portion is not limited to mattress covers with stretch panels provided only at the ends, but could also be applied to impart stretchability, longitudinal and/or otherwise, to a greater portion of the skirt or its entirety.

In the embodiments described thus far, the stretch end panels would, upon installation on a mattress, extend fully across the longitudinal dimension of the mattress end walls, being directly attached at their ends to corresponding end edges of the sidewall extension panels. This is not necessarily the case. In an alternative embodiment of the invention, the stretch end panels may comprises one or more panels that span less than the entire longitudinal dimension of the mattress end walls, with the remainder being covered by another material, e.g., a unitary extension of the extension end walls, or one or more separately formed and attached pieces of material (which need not be stretchable). As just one example of the many possibilities in this regard, a pair of approximately 10" square panels of stretch material could be attached under tension in the general manner previously described, but so as to provide two relatively short stretch end panels at the ends of the composite end panel formed, one adjacent each of the corners and having a mitered seam connecting the panel to a corresponding end edge of a corresponding sidewall extension panel. In another embodiment, the stretch panels could be positioned inwardly of the corners such that their attachment to the end edges of the sidewall extension panels is indirect, i.e., through other material of the composite end panels.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A fitted mattress cover comprising:

a top panel of material for fitting in overlaying relationship to the top surface of a mattress; and a peripheral skirt depending from the periphery of the top panel for fitting in overlaying relationship to the sides and ends of the mattress, the peripheral skirt comprising:

a pair of extension sidewall panels attached to the top panel, said sidewall panels being sized and configured to overlie substantially the entire sides of the mattress;

a pair of extension end panels attached to the top panel, at least one of said end extension end panels being sized and configured to overlie substantially only an upper partial portion of the end walls of the mattress; and at least one stretch end panel sized and configured to overlie substantially only a lower partial portion of a respective end wall below the upper partial portion, said at least one stretch end panel being formed of a stretchable material stretchable in at least a longitudinal direction thereof so as to generate an at least partial recovery force, the stretch end panel being attached along its upper edge thereof to a corresponding peripheral edge of a corresponding one of the extension end panels and being attached at its ends, either directly or indirectly, to corresponding end edges of the sidewall panels, whereby upon installation of the mattress covering, the at least partial recovery force pulls on said end edges of the sidewall panels.

2. The mattress cover of claim 1, wherein the mattress cover is a fitted sheet.

3. The mattress cover according to claim 1, wherein said at least one stretch end panel is substantially rectangular in shape, and the attachment of the same to corresponding end edges of the extension sidewall panels comprises a seam that extends orthogonally with respect to the longitudinal directions of the stretch end panels and extension sidewall panels.

4. The mattress cover of claim 1, further comprising an elastic strip attached along the bottom peripheral edge of the skirt.

5. The mattress cover of claim 1, wherein said material forming each of the top panel, extension sidewall panels and the extension end panels is a substantially inelastic, substantially non-stretchable material.

6. The mattress cover of claim 1, wherein an upper edge portion of the at least one stretch end panel is attached to the corresponding peripheral edge of the corresponding extension end panel under tension, such that upon being permitted to relax, the recovery of the stretch material to its relaxed state draws the stretch end panel material inwardly upon itself and carries with it the peripheral edge of the extension end panel to thereby form gathers in the extension end panel along the seam joining the stretch end panel thereto, whereby, at the time of installing the mattress covering on a mattress, the stretch end panels are permitted to stretch longitudinally, without such stretch being impeded at the upper edge portion of the stretch panel by the attachment to the extension end panel.

7. The mattress cover of claim 1, wherein said stretchable material comprises elastic elements imparting a longitudinal elastic stretchability to the material.

8. The mattress cover of claim 7, wherein the stretchable material is substantially non-stretchable in a transverse direction of said stretch end panels.

9. The mattress cover of claim 7, wherein said stretchable material comprises spandex yarns.

10. The mattress cover of claim 1, wherein said stretchable material comprises a stretch knit material.

11. The mattress cover of claim 1, wherein the pair of extension sidewall panels are formed as unitary extensions of the material forming the top panel.

12. The mattress cover of claim 1, wherein the pair of extension end panels are formed as unitary extensions of the material forming the top panel.

13. The mattress cover of claim 1, wherein at least one end of the at least one stretch end panel is attached directly to a corresponding end edge of one of the extension sidewall panels.

14. The mattress cover of claim 13, wherein the at least one stretch end panel spans the entirety of the peripheral edge of the extension end panel to which it is attached, and each end of the at least one stretch end panel is attached directly to a corresponding end edge of a respective extension sidewall panel.

15. The mattress cover of claim 1, wherein a pair of said stretch end panels are provided, one at each of opposite ends of the mattress cover and attached to a corresponding extension end panel.

16. A method of making a fitted mattress cover having a top panel for fitting in overlaying relationship to a top surface of a mattress and a peripheral skirt for overlaying the sides and ends of the mattress, comprising the steps of:

forming a main fabric piece having a top panel sized and configured for fitting in overlaying relationship to the top surface of a mattress, two opposite extension side panels coextensive in length with the top panel so as to overlie substantially the entire sides of the mattress, and two opposite extension end panels coextensive in length with the width of the top, at least one of said opposite extension end panels having a depth which is less than a depth of the two opposite side panels, so as to overlie substantially only an upper partial portion of the end walls of the mattress;

attaching at least one stretch end panel along a respective longitudinal edge thereof to a corresponding peripheral edge of a corresponding one of the extension end panels to form a composite end panel, said at least one stretch end panel being sized and configured to overlie substantially only a lower partial portion of the end walls below said upper partial portion, said stretch end panels being formed of a stretchable material stretchable in at least a longitudinal direction thereof so as to generate an at least partial recovery force when placed in a stretched condition; and attaching adjacent end edges of the composite end panels and side panels together to form said peripheral skirt.

17. A method of making a fitted mattress cover according to claim 16, wherein the upper edge of the at least one stretch end panel is stretched in its longitudinal dimension as the longitudinal edge of the panel is attached to the corresponding peripheral edge of the at least one extension end panel.

18. A method of making a fitted mattress cover according to claim 16, wherein the upper edge of the at least one stretch end panel is progressively stretched in its longitudinal dimension in increments as the longitudinal edge of the stretch end panel is attached to the corresponding peripheral edge of the at least one extension end panel, and then allowed to relax.

19. A method of making a fitted mattress cover according to claim 18, wherein the longitudinal edge of the stretch end panel is attached to the corresponding peripheral edge of the at least one extension end panels by stitching a seam.

20. A method of making a fitted mattress cover according to claim 16, wherein the pair of extension sidewall panels are formed as unitary extensions of the material forming the top panel.

21. A method of making a fitted mattress cover according to claim 16, wherein the pair of extension end panels are formed as unitary extensions of the material forming the top panel.

22. A method of making a fitted mattress cover according to claim 16, wherein a pair of said stretch end panels are provided, one at each of opposite ends of the mattress cover and attached to a corresponding extension end panel.

23. A method of making a fitted mattress cover according to claim 16, wherein the mattress cover is a fitted sheet.

* * * * *